United States Patent [19]

McArthur et al.

[11] Patent Number: 5,037,107

[45] Date of Patent: Aug. 6, 1991

[54] VERTICAL MAGNETIC GAME APPARATUS

[76] Inventors: James K. McArthur; Gary R. McArthur, both of 595 Agnew Rd., Pulaski, Tenn. 38478

[21] Appl. No.: 573,356

[22] Filed: Aug. 27, 1990

Related U.S. Application Data

[63] Continuation-in-part of Ser. No. 457,851, Dec. 27, 1989, abandoned.

[51] Int. Cl.[5] ..... A63F 3/00

[52] U.S. Cl. ..... 273/239; 273/456; 273/282

[58] Field of Search ..... 273/1 M, 239, 241, 282 A

[56] References Cited

U.S. PATENT DOCUMENTS

| | | | |
|---|---|---|---|
| 3,082,004 | 3/1963 | Friedman | 273/241 |
| 3,674,272 | 7/1972 | Wszalek | 273/241 |
| 3,799,548 | 3/1974 | Lenkin | 273/241 |
| 4,205,850 | 6/1980 | Craig | 273/241 |
| 4,381,112 | 4/1983 | Dupuy | 273/239 |

FOREIGN PATENT DOCUMENTS

| | | | |
|---|---|---|---|
| 2278369 | 3/1976 | France | 273/239 |

*Primary Examiner*—Edward M. Coven
*Assistant Examiner*—Raleigh W. Chiu
*Attorney, Agent, or Firm*—John C. Garvin, Jr.

[57] ABSTRACT

A magnetic game apparatus adapted to be played on both sides of a vertically mounted board by two players using magnetic playing pieces. The magnetic game apparatus includes a game board having an organized series of openings therethrough and a plurality of magnetized playing pieces for movement between the openings in the game board. Each playing piece is provided with a permanent magnet on one of its ends of either a positive or negative polarity which will either attract or repel a playing piece positioned within one of the organized series of openings on the opposite side of the game board.

28 Claims, 6 Drawing Sheets

VERTICAL MAGNETIC GAME APPARATUS

This application is a continuation-in-part of application Ser. No. 07/457,851, filed Dec. 27, 1989, now abandoned.

BACKGROUND OF THE INVENTION

This invention relates to a magnetic game apparatus, and more particularly to an apparatus adapted to be played on both sides of a vertically mounted board using magnetic playing pieces.

The present invention is a novel game for two players which is designed to test the memory recall of the players of the game and tends to increase the suspense and interest of the players as they strategically select the movement of playing pieces during the game. The present invention includes a vertical playing board having an organized series of openings therethrough and a plurality of magnetized playing pieces for movement between the openings in the board. In any game played on the game board, approximately one-half of the playing pieces have a permanent magnet on one of its ends of negative polarity so that when a playing piece is placed in an opening in one side of the board, the newly placed playing piece will either be attracted to or repel the first placed playing piece. Each player will normally have the same number of playing pieces of positive and negative polarities; however, they need not be an equal number of each. The present invention combines skill, chance, memory recall, and strategy in a game of great interest to persons of all ages.

The prior art abounds with game apparatuses which use boards and playing pieces where the players attempt to develop a winning strategy as they move the playing pieces to desired locations on the board. There apparently have been only a limited number of such prior art game apparatuses which utilize a vertically mounted board with magnetized playing pieces. Such prior art game apparatuses known to utilize vertically mounted boards and magnetized playing pieces are disclosed in U.S. Pat. No. 3,082,004 to Sol Friedman; U.S. Pat. No. 3,674,272 to Ferdinand J. Wszalek; and U.S. Pat. No. 3,799,548 to Jack L. Lemkin. The structure and arrangement of the board and playing pieces together with the rules and objectives of the prior art game apparatuses differ substantially from those for the present invention.

It is an object of the present invention to provide a vertical game apparatus which is simple and inexpensive to manufacture and which uses magnetic playing pieces.

It is a further object of the present invention to provide a vertical game apparatus which requires skill, chance, memory recall and strategy of the players using the game apparatus.

It is still a further object of the present invention to provide a vertical magnetic game apparatus with means for playing a variety of games which incorporates the elements of skill and chance to make the game apparatus attractive for two or more players of differing ages and skill.

Benefits and advantages of the present invention will become apparent to those skilled in the art to which the invention relates from the subsequent description of the preferred embodiments and the appended claims, taking in conjunction with the accompanying drawings.

DESCRIPTION OF THE PREFERRED EMBODIMENT

Figure 1:
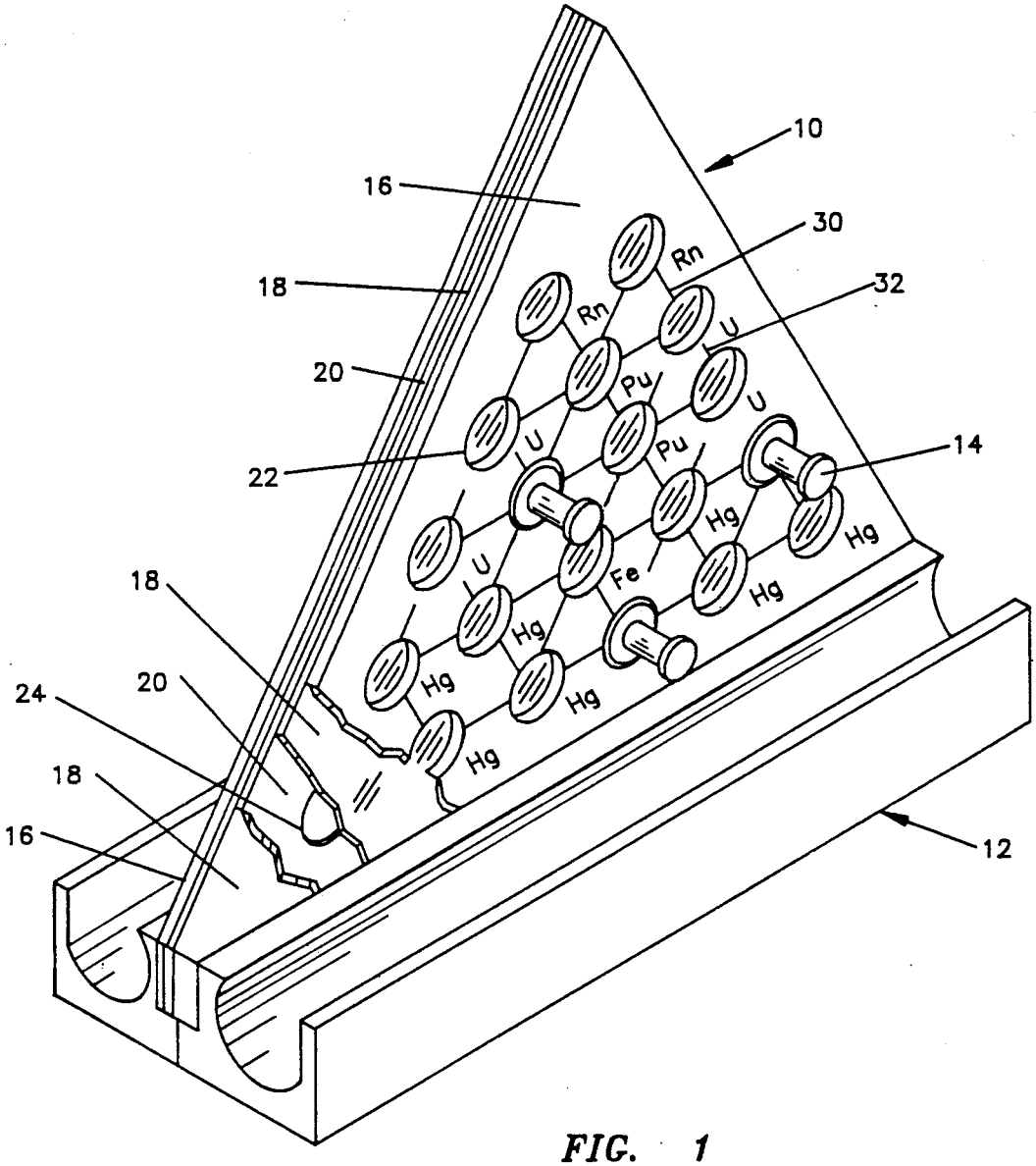
FIG. 1 is a partially broken away perspective view of one embodiment of the invention showing one side of the game board having three magnetic playing pieces thereon.
Figure 2:
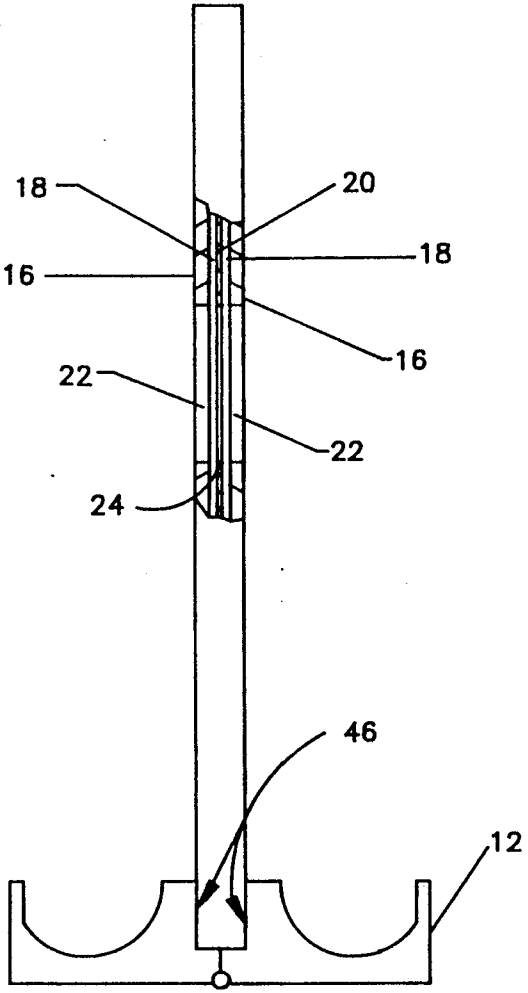
FIG. 2 is an end elevational view of the game board of FIG. 1 with a portion thereof being broken away to show the interior details of the game board.

FIGS. 1 and 2 illustrate, by way of example, one embodiment of the game board of the invention, in a triangular configuration, with a plurality of magnetized playing pieces thereon. As illustrated, the vertical magnetic game apparatus comprises a vertically disposed game board 10 mounted on a base 12, and a plurality of magnetized playing pieces 14.

The game board 10 includes two outer face plates 16 made of any suitable non-magnetic material such as a fiberboard or plastic; two pieces of transparent material 18 such as clear vinyl; and one piece of magnetically attractive material 20, such as sheet metal, sandwiched between the two pieces of transparent material 18 and the two outer face plates 16. As best illustrated in FIG. 1, each of outer face plates 16, transparent material 18, and sheet metal 20 is triangular in configuration in the preferred embodiment of the invention.

As best shown in FIGS. 1 and 2, each outer face plate 16 has a series of openings 22 therein. Openings 22 may be placed in outer face plates 16 by cutting or punching operations or by any other conventional means. Openings 22 are arranged in each outer face plate 16 such that when game board 10 is assembled, as best illustrated in FIGS. 1 and 2, the openings 22 in one outer face plate 16 are in alignment with openings 22 in the other outer face plate 16. Each of the two pieces of transparent material 18 is solid throughout and has no openings therein. The two pieces of transparent material 18 serve as a stop to restrict the depth that a playing piece 14 may be inserted into an opening 22 and as a window to enable a player on one side of game board 10 to see the location or position of his opponent's playing pieces 14 on the opposite side of game board 10. While a player will know the location of his opponent's playing pieces 14 on game board 10, the player, when first positioning one of his playing pieces 14 in an opening 22, would not know the polarity of a particular playing piece 14 positioned on the opposite side of game board 10. Each player will learn the polarity of the particular playing piece 14 of his opponent after the playing piece 14 is either attracted to his opponent's playing piece 14 or his opponent's playing piece 14 is repelled from game board 10. It is then most important that each player remember the exact polarity of that playing piece 14 to enhance the possibilities of winning the game.

The magnetically attractive member 20 has a series of holes 24 (FIGS. 1 and 2) therein, which are the same size or slightly larger or slightly smaller than openings 22 in the two outer face plates 16 and being concentric therewith in the assembled game board 10.

Member 20 serves as a means to be attracted by permanent magnet 28 on playing pieces 14 irrespective of the polarity of playing piece 14 when the playing piece 14 is placed within an opening 22 in game board 10 to retain the playing piece 14 in opening 22 except when being repelled therefrom by an opponent's playing piece 14. The area of magnetically attractive member 20 around the periphery of holes 24 in member 20 causes the attraction. Member 20 also serves to retain playing pieces 14 (by magnetic attraction) along the edges of game board 10 after a player has moved his playing pieces 14 to the desired location on game board 10. When assembled by any conventional means such as binding material, rivets, nuts and bolts or adhesives, magnetically attractive member 20 is sandwiched between the two pieces of transparent material 18 and outer face plates 16 with openings 22 of the outer face plates 16 being in alignment with each other and with holes 24 in magnetically attractive member 20.

Figure 4:
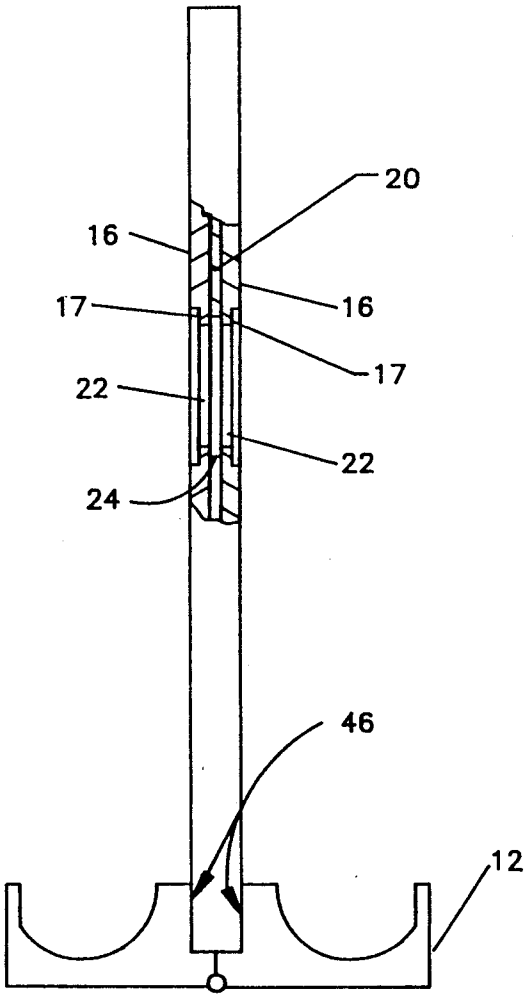
FIG. 4 is an end elevational view of the game board of FIG. 3 with a portion thereof being broken away to show the interior details of the game board.
Figure 3:
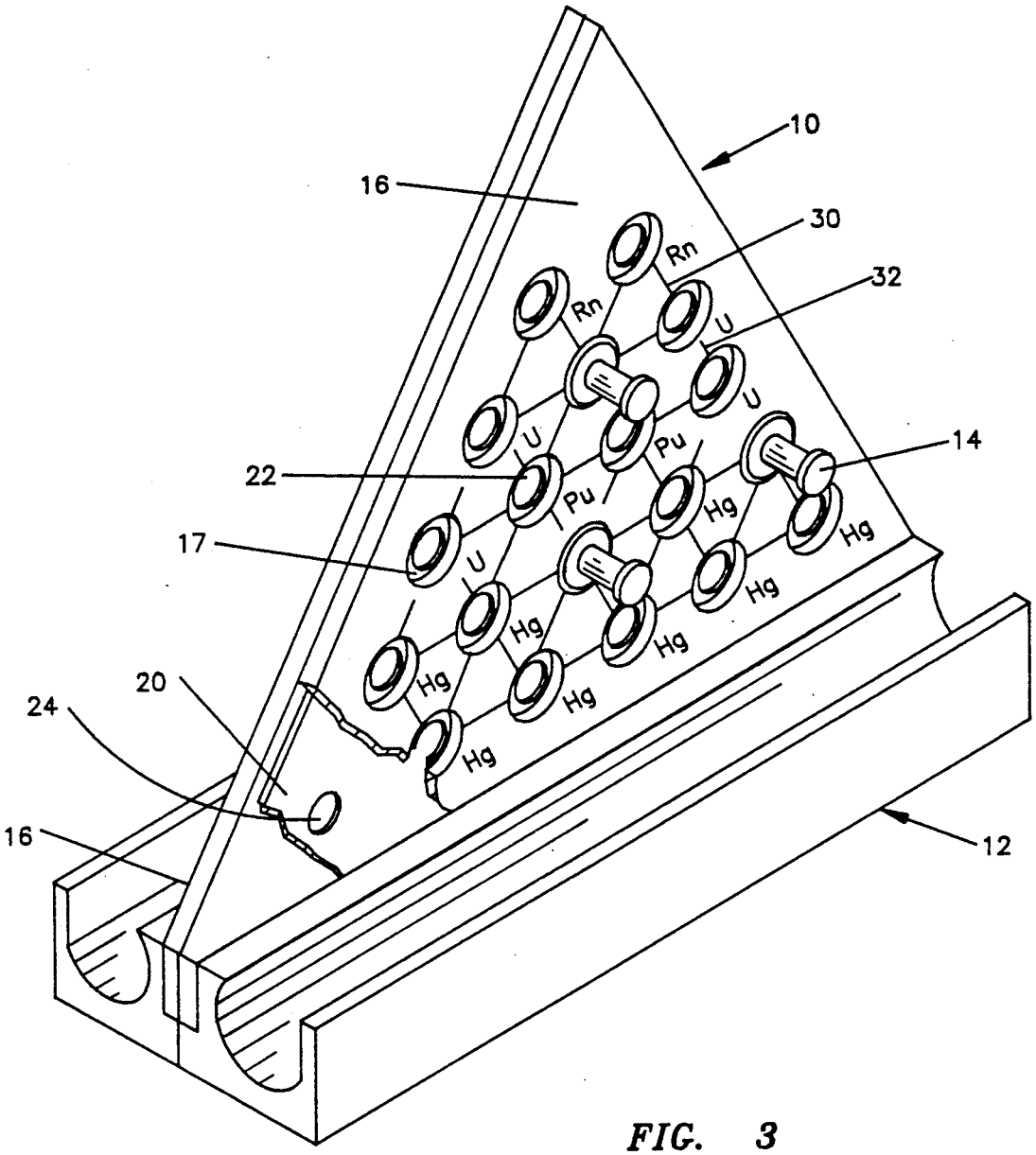
FIG. 3 is a partially broken away perspective view of a second embodiment of the invention showing one side of the game board having three magnetic playing pieces thereon.

FIGS. 3 and 4, illustrate by way of example, a second embodiment of the game board of the invention with the use of the same reference numerals to designate like or similar parts disclosed in FIGS. 1 and 2 for the first embodiment of the invention. The game board 10 of the second embodiment (FIGS. 3 and 4) differs from that of the first embodiment (FIGS. 1 and 2) only in the elements which stop or restrict the movement of playing pieces 14 within openings 22 in each outer face plate 16. In this second embodiment (FIGS. 3 and 4), the two pieces of transparent material 18 are eliminated and shoulders or ridges 17 are incorporated in the walls of openings 22 adjacent the interior surfaces of outer face plates 16 to stop or restrict the movement of playing pieces 14 within openings 22. As best shown in FIG. 4, ridges or shoulders 17 protrude or extend into openings 22 only a short distance, thus allowing a player on one side of game board 10 to see the locations or positions of his opponent's playing pieces 14 on the opposite side of game board 10.

Figure 6:
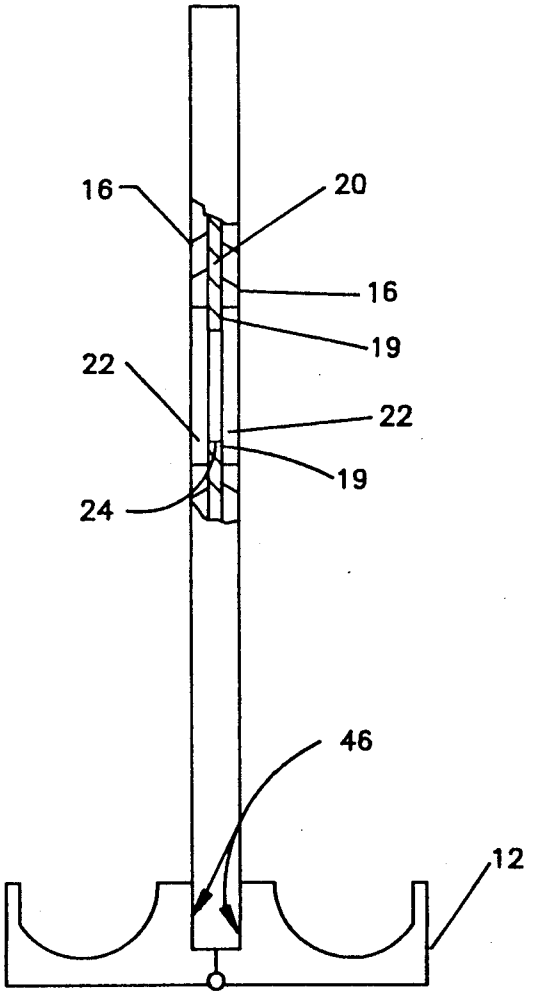
FIG. 6 is an end elevational view of the game board of FIG. 5 with a portion thereof being broken away to show the interior details of the game board.
Figure 5:
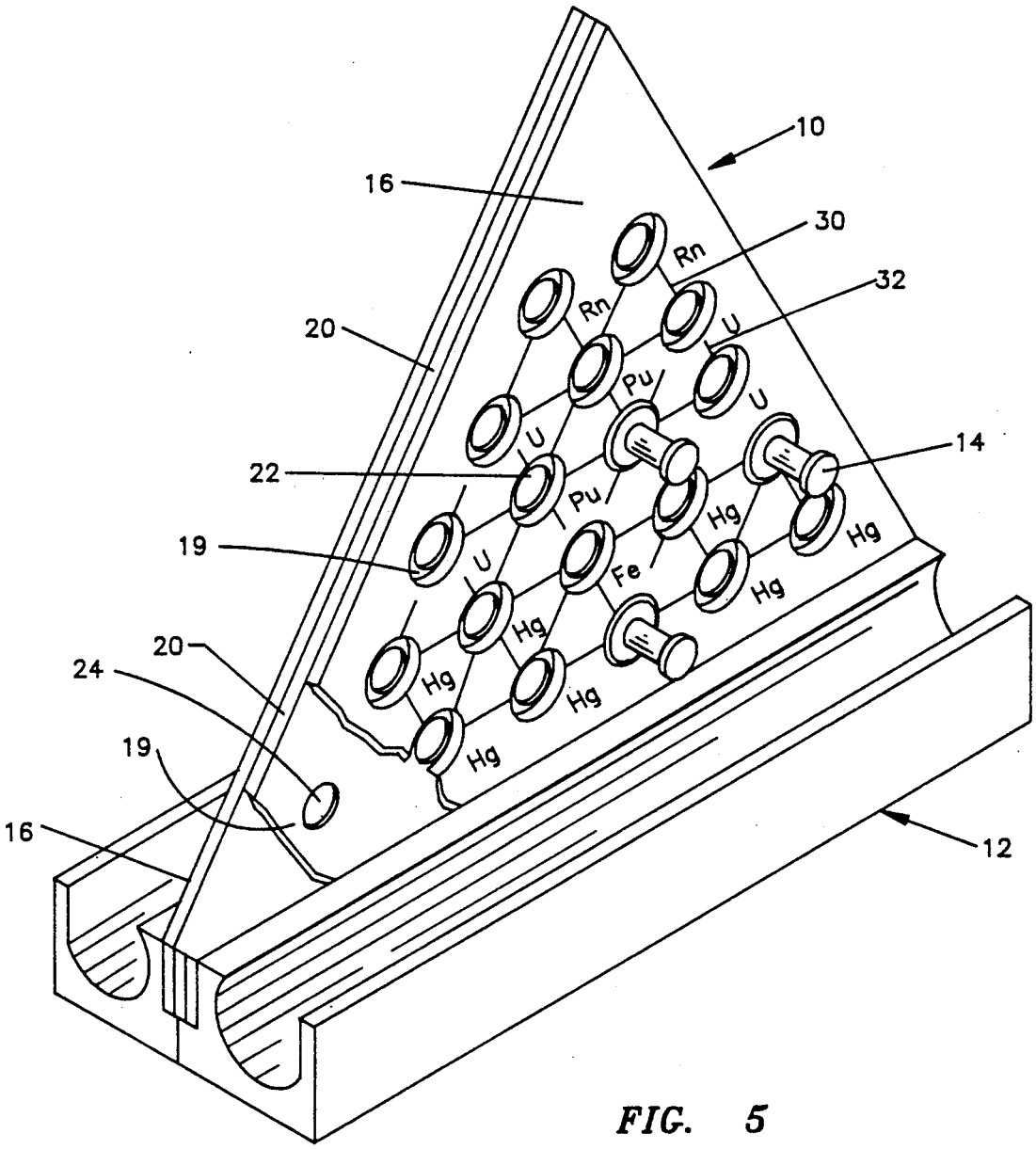
FIG. 5 is a partially broken away perspective view of a third embodiment of the invention showing one side of the game board having three magnetic playing pieces thereon.
Figure 9:
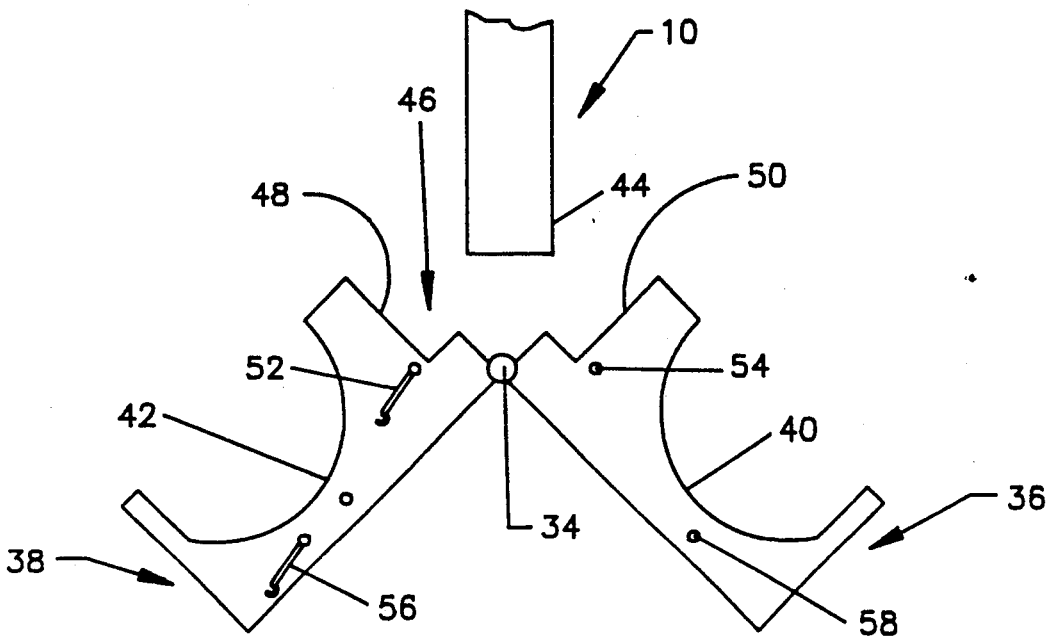
FIG. 9 is an end elevational view of the base for supporting the game board.

FIGS. 5 and 6, illustrate by way of example, a third embodiment of the game board 10 of the invention with the use of the same reference numerals to designate like or similar parts disclosed in FIGS. 1 and 2 for the first embodiment of the invention. The game board 10 of the third embodiment (FIGS. 5 and 6) differs from that of the first embodiment (FIGS. 1 and 2) and the second embodiment (FIGS. 3 and 4) only in the elements which stop or restrict the movement of playing pieces 14 within openings 22 in each outer face plate 16. In this third embodiment (FIGS. 5 and 6), the two sheets of transparent material 18 (FIGS. 1 and 2) and shoulders or ridges 17 (FIGS. 3 and 4) are eliminated and the holes 24 in magnetically attractive member 20 are made slightly smaller than openings 22 in the two outer face plates 16 and the outer dimensions of magnets 28 attached to the handle or stem 26 of playing pieces 14, thus allowing the surfaces 19 (FIG. 6) surrounding each hole 24 of magnetically attractive member 20 to stop or restrict movement of playing pieces 14 within openings 22 of outer face plates 16. In the third embodiment (FIGS. 5 and 6), holes 24 are of such a size that a player on one side of game board 10 can readily see the locations of his opponent's playing pieces 14 on the opposite side of game board 10.

It is apparent that openings 22 in outer face plates 16 could be tapered (not shown in drawings), with the smallest portions of openings 22 being adjacent the interior face of face plates 16 to provide the stop or movement restriction means, for still a fourth embodiment of the invention. In this fourth embodiment, the magnets 28 on playing pieces 14 might also be tapered, but they need not be.

Figure 7:
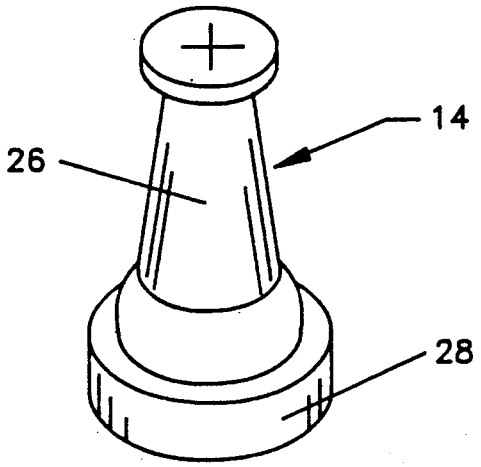
FIG. 7 is a perspective view of a preferred embodiment of a magnetized playing piece of positive polarity for use with the game board of the present invention.

As best illustrated in FIG. 7, each magnetized playing piece 14 includes a handle or stem 26 having a permanent magnet 28 attached to one end with the other end of handle 26 being marked, for example with either a "+" or "−" sign or being round or square shaped, to denote whether the magnet 28 bears a positive (+) or a negative (−) charge. For reasons explained hereinbelow, while utilizing the game apparatus, it is essential that each player has knowledge of the charge on each of his playing pieces 14 and that his opponent not know the specific charge on any particular playing piece.

In the preferred embodiments of game board 10, openings 22 in outer face plates 16 and holes 24 in magnetically attractive member 20 are staggered to be shaped as a pyramid or triangle. In this arrangement, as illustrated best in FIGS. 1 and 4, there are six sets of openings 22 and holes 24 on the bottom row; five sets of openings 22 and holes 24 on the second row; four sets of openings 22 and holes 24 on the third row; three sets of openings 22 and holes 24 on the fourth row; and two sets of openings 22 and holes 24 on the top row. Openings 22 and holes 24 on each row are in horizontal alignment. Openings 22 and 24 in even numbered rows are in vertical alignment as are openings 22 and 24 in odd numbered rows. Openings 22 and 24 are also in diagonal alignment as illustrated best in FIG. 1.

Figure 8:
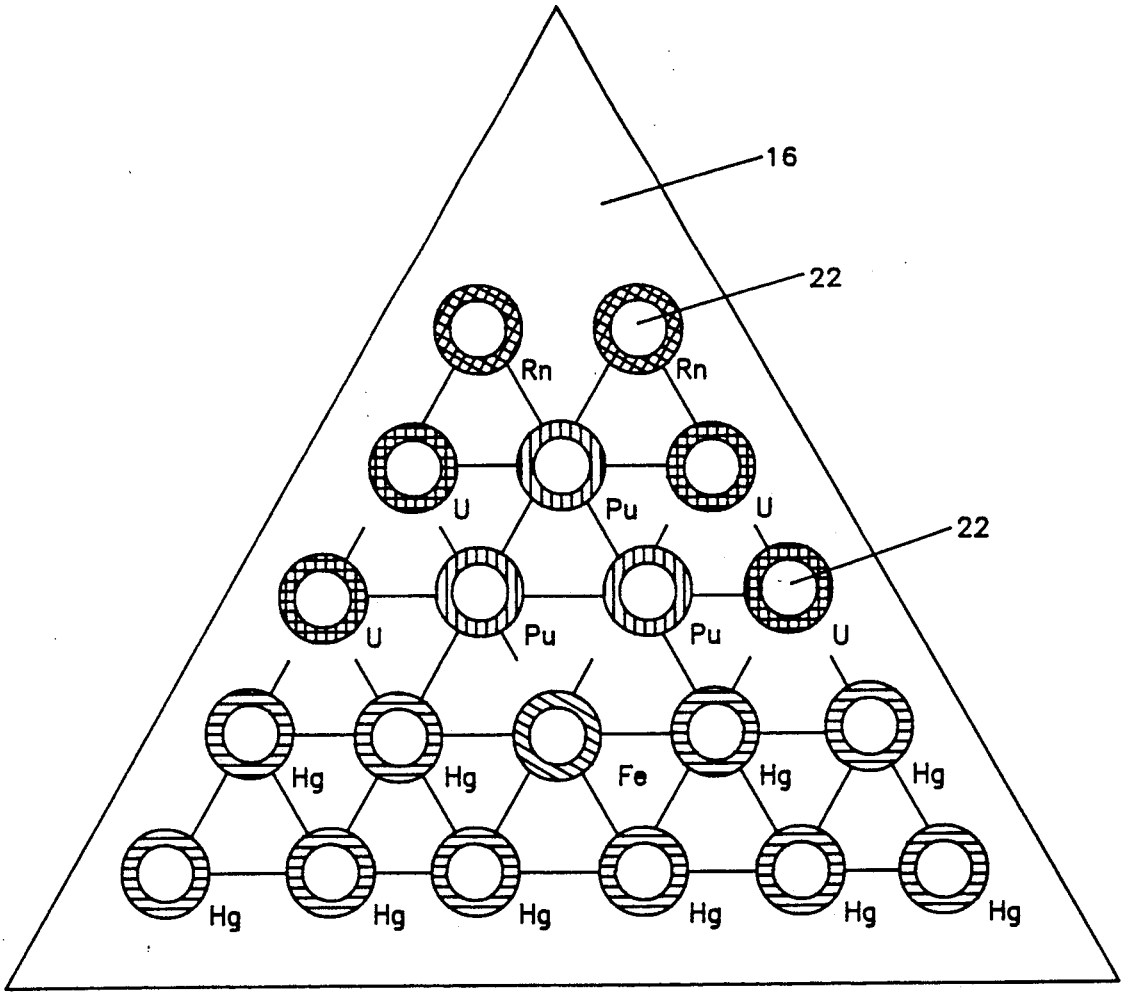
FIG. 8 is an elevational view of the game board showing the color scheme of the game board for each embodiment and path layout for the playing pieces.

Each opening 22 in outer face plate 16 is surrounded on its outer perimeter by one of a plurality of selected colors. As also illustrated in FIG. 8 by color codes, five separate and distinct colors are used in the preferred embodiments of the invention. It being understood that a greater or lesser number of colors could be used with the instant game apparatus. Each colored opening 22 is also given a name from the known chemical elements to provide variety to the games which might be played on the game apparatus. Utilizing the colors which are color coded in FIG. 8, blue denotes mercury having the symbol "Hg"; yellow denotes uranium having the symbol "U"; red denotes plutonium having the symbol "Pu"; orange denotes radon having the symbol "Rn"; and green denotes iron having the symbol "Fe".

As further illustrated in FIGS. 1, 3, 5 and 8, there are a number of solid lines 30 connecting some of openings 22 and a number of solid lines 32 extending only part way between some of openings 22. As will be explained in more detail hereinbelow, the existence of a full line 30 or partial line 32 controls the direction of possible movements of playing pieces 14.

To support the game board in vertical position, a base 12 may be provided. The base is comprised of two substantially elongated sections 36 and 38 each having a trough 40 and 42, respectively, disposed therein to catch and retain the game pieces 14 as they are repelled from the board. The base 12 is foldable along a pivot joint 34 to permit storage and transportability of the game. The board 10 includes a base portion 44 which is insertable into a recess 46 defined by a pair of offset portions 48 and 50 of each section 36 and 38 of the base 12. To secure the foldable sections 36 and 38 in operable position for retention of board 10 in recess 46, a hook member 52 is shown to be provided on section 38 for secured relation with a pin 54 shown in section 36. To secure the base in storage or in the transport position, a hook member 56 is shown on base section 38 for secured relation with a pin 58 disposed on base section 36. A second similar set of hook members and pins may be provided on the opposite ends of the base sections 36 or 38, if desired.

One game which may be played on the vertical game board apparatus of the present invention might be called "Polaritease", a description of which follows. With the number of openings 22 shown in the preferred embodiment, the two players determine the number of playing pieces 14, which might be referred to as "electrons", to be used in that game. With the preferred embodiments of game board 10, each player will have up to six electrons 14 (three positive and three negative), but each player must play with the same number of electrons 14 with the same ratio of electrons 14 with positive and negative charges. Generally, the more electrons 14 used in a given game, the more complex the game. It is not necessary that each player has an equal number of positive and negative charged electrons 14 as the game can be played with each player having a different number of positive and negative charged electrons 14; for example, each player could have three positive charged electrons 14 and two negative charged electrons 14 in any given game.

The objective of "Polaritease" is for each player on opposite sides of game board 10 to take all of his electrons 14 from a troughs 40 or 42 and place each of them in one of openings 22 on the bottom row (marked blue or Hg) on his side of game board 10 and continue moving them toward one of openings 22 (marked red or Pu) and take them off before his opponent can do so. In "Polaritease", openings 22 are referred to as "atoms". Movement of electrons 14 is alternated from one player to the other and is restricted to one space, as explained hereinbelow, unless the player encounters one of his opponent's electron 14. As set forth hereinabove, a player can always see the location of each opponent's electron 14 because stop means 18 is transparent (FIGS. 1 and 2) or there is an opening (FIGS. 3 and 4 and FIGS. 5 and 6) to see through, but the player will not know the polarity of each electron 14 prior to the first encounter of one of his electrons 14 with one of his opponent's electrons 14. After reaching one of the red or Pu atoms 22, and all remaining electrons 14 are on the game board, the player removes the electron 14 from the atom 22 and places it along the edge of game board 10 where the magnet 28 of the electron 14 is attracted to magnetically attractive member 20 and the electron 14 is retained on the edge of game board 10. This is important in that it makes the opponent better aware of the number of electrons 14 and polarity of the remaining electrons still in play.

As set forth hereinabove, Player #1 starts the game by placing one of his electrons 14 into one of the atoms 22 (marked blue or Hg). Player #2 then places one of his electrons 14 into one of his atoms 22 (marked blue or Hg). Player #2 has the option of placing his electron 14 into an atom 22 opposite that housing an electron 14 of Player #1. If so, electron 14 will either repel Player #1's electron 14 from game board 10 or be attracted to Player #1's electron 14.

If Player #1's electron 14 is repelled from game board 10, Player #2 has the option of remaining in that atom 22 or taking an additional move with that same electron 14. Player #1 must restart that electron 14 on the trough 40 or 42 below the bottom row of atoms 22. If Player #2 elects to take an additional move with that particular electron 14, he can move it only in the directions in which either a solid line 30 or a partial line 32 leads toward another atom 22. Player #2 is further restricted in that he cannot move upward on the additional move if his previous movement was in a downward direction and he can move downward on the additional move only if his direction of movement when encountering electron 14 of Player #1 was either downward or sideway.

If Player #2's electron 14 is attracted to Player #1's electron 14, Player #2 must make an additional move downward even if there is no solid line 30 or partial line 32 leading from the particular atom 22 to a lower positioned atom 22. If Player #2's electron 14 was in an atom 22 (marked blue or Hg) on the bottom of game board 10, the only downward movement would be back off board 10 onto the trough 40 or 42. The game of "Polaritease" is continued with each player moving their electrons 14 in the manner described hereinabove until one player has moved all of his electrons 14 into one of atoms 22 marked red or Pu and removed to the edge of game board 10. The movement to the edge constitutes a move by either Player #1 or Player #2.

While the above description constitutes preferred embodiments of the present invention and describes one of the games ("Polaritease") which might be played thereon, it will be appreciated that the invention is susceptible to modification, variation and change without departing from the proper scope and fair meaning of the accompanying claims.

What is claimed is:

1. A magnetic game apparatus comprising:

a game board having two face plates, each of said face plates having a plurality of organized matching openings therethrough, a magnetically attractive member positioned adjacent said face plates, said magnetically attractive member having a plurality of organized openings therein in alignment with said openings in said face plates, stop means disposed adjacent to and extending at least partially within said openings and means for securing said face plates to said magnetically attractive member;

means for supporting said game board in an upright, vertical, position; and a plurality of playing pieces disposed for insertion into and for selective movement between the openings in said face plates.

2. The magnetic game apparatus of claim 1 wherein said stop means comprises projecting means disposed on the peripheral surfaces of said openings of at least one of said face plates, said projecting means extending into said openings to limit the extent of insertion of said playing pieces into said openings.

3. The magnetic game apparatus of claim 2 wherein said projecting means is defined by a shoulder.

4. The magnetic game apparatus of claim 2 wherein said projecting means is disposed on said peripheral surfaces around said openings on each of said face plates.

5. The magnetic game apparatus of claim 2 wherein said projecting means is disposed in said openings adjacent said magnetically attractive member.

6. The magnetic game apparatus of claim 2 wherein each of said playing pieces comprises a stem and a permanent magnet secured to one end of said stem, each of said permanent magnets having external dimensions slightly smaller that the internal dimensions of said openings in said face plates to provide a close fit when one of said playing pieces is inserted into one of said openings in one of said face plates.

7. The magnetic game apparatus of claim 6 wherein said projecting means limits the extent of insertion of said playing pieces within said openings in said face plates, said openings in said face plates and said magnetically attractive member being disposed for allowing a player on one side of said vertical game board to see the positions of his opponent's playing pieces on the other side of said vertical game board.

8. The magnetic game apparatus of claim 7 wherein a predetermined number of said permanent magnets on said playing pieces have a positive polarity and a predetermined number of said permanent magnets on said playing pieces have a negative polarity with the polarity of the permanent magnet being marked on said stem of each said playing piece.

9. The magnetic game apparatus of claim 8 wherein said two face plates provide playing surfaces for two players positioned on opposite sides of said game board whereby when one of said players positions one of his said playing pieces within one of said openings in one of said face plates of said game board opposite an opening in the other of said face plates housing one of said playing pieces of the other of said players, said playing piece of said other of said players will either be attracted to or be repelled by said playing piece of said one of said players, dependent upon the polarity of said permanent magnets on said playing pieces.

10. The magnetic game apparatus of claim 1 wherein said openings in said magnetically attractive member are of a size slightly smaller than said openings in each of said face plates so that the edge portions of said magnetically attractive member surrounding each of said openings in said magnetically attractive member defines said stop means.

11. The magnetic game apparatus of claim 10 wherein each of said playing pieces comprises a stem and a permanent magnet secured to one end of said stem, each of said permanent magnets having external dimensions slightly smaller that the internal dimensions of said openings in said face plates to provide a close fit when one of said playing pieces is positioned within one of said openings in one of said face plates.

12. The magnetic game apparatus of claim 11 wherein said openings in said face plates and said magnetically attractive member allow a player on one side of said vertical game board to see the positions of his opponent's playing pieces on the other side of said vertical game board.

13. The magnetic game apparatus of claim 12 wherein a predetermined number of said permanent magnets on said playing pieces have a positive polarity and a predetermined number of said permanent magnets on said playing pieces have a negative polarity with the polarity of the permanent magnet being marked on said stem of each said playing piece.

14. The magnetic game apparatus of claim 13 wherein said two face plates provide playing surfaces for two players positioned on opposite sides of said game board whereby when one of said players positions one of his said playing pieces within one of said openings in one of said face plates housing one of said playing pieces of the other of said players, said playing piece of said other of said players will either be attracted to or be repelled by said playing piece of said one of said players, dependent upon the polarity of said permanent magnets on said playing pieces.

15. A magnetic game apparatus comprising:

a game board having two face plates, each of said face plates having a plurality of organized matching openings therethrough, transparent stop means positioned adjacent the inner surface of at least one of said face plates, a magnetically attractive member positioned adjacent said transparent stop means, said magnetically attractive member having a plurality of organized holes therein in alignment with said openings in said face plates, and means for securing said face plates to said transparent stop means and said magnetically attractive member;

means for supporting said game board in an upright, vertical, position; and a plurality of playing pieces for selective movement between the openings in said face plates.

16. The magnetic game apparatus of claim 15 wherein said transparent stop means comprises two sheets of clear plastic.

17. The magnetic game apparatus of claim 16 wherein each of said sheets of clear plastic is mounted on each side of said magnetically attractive member and adjacent one of said face plates.

18. The magnetic game apparatus of claim 17 wherein each of said playing pieces comprises a stem and a permanent magnet secured to one end of said stem.

19. The magnetic game apparatus of claim 18 wherein each of said permanent magnets has external dimensions slightly smaller that the internal dimensions of said openings in said face plates to provide a close fit when one of said playing pieces is positioned within one of said openings in one of said face plates.

20. The magnetic game apparatus of claim 19 wherein said openings in said face plates are of the same size as the size of said holes in said magnetically attractive member.

21. The magnetic game apparatus of claim 19 wherein said openings in said face plates are of a size slightly larger than the size of said holes in said magnetically attractive member.

22. The magnetic game apparatus of claim 19 wherein said openings in said face plates are of a size slighter smaller than the size of said holes in said magnetically attractive member.

23. The magnetic game apparatus of claim 21 wherein said holes in said magnetically attractive member, said openings in said face plates, and said permanent magnets on said playing pieces are round in configuration.

24. The magnetic game apparatus of claim 23 wherein said two transparent sheets of clear plastic prevent said playing pieces from being inserted too far within said openings in said face plates and allows a player on one side of said vertical game board to see the positions of his opponent's playing pieces on the other side of said vertical game board.

25. The magnetic game apparatus of claim 24 wherein a predetermined number of said permanent magnets on said playing pieces have a positive polarity and a predetermined number of said permanent magnets on said playing pieces have a negative polarity with the polarity of the permanent magnet being marked on said stem of each said playing piece.

26. The magnetic game apparatus of claim 25 wherein said magnetically attractive member attracts said permanent magnets on said playing pieces when positioned within one of said openings in said face plates irrespective of the polarity of any specific said permanent magnet to retain said playing piece within said opening of said face plate.

27. The magnetic game apparatus of claim 26 wherein said means for supporting said game board in vertical, upright, position comprises two elongated sections, pivot mean for joining said elongated sections, said elongated sections being foldable at said pivot means between an operable condition for supporting said game board and a storage condition, and latch means for securing said elongated sections in said operable and storage conditions, each of said elongated sections having a trough therein for supporting said playing pieces when said playing pieces are not in play on said game board and when said elongated sections are in said operable condition.

28. The magnetic game apparatus of claim 26 wherein said two face plates provide playing surfaces for two players positioned on opposite sides of said game board whereby when one of said players positions one of his said playing pieces within one of said openings in one of said face plates of said game board opposite an opening in the other of said face plates housing one of said playing pieces of the other of said players, said playing piece of said other of said players will either be attracted to or be repelled by said playing piece of said one of said players, dependent upon the polarity of said permanent magnets on said playing pieces.

* * * * *